United States Patent [19]

Sluyterman et al.

[11] Patent Number: 4,922,167

[45] Date of Patent: May 1, 1990

[54] PICTURE DISPLAY DEVICE HAVING MEANS FOR COMPENSATING LINE STRAY FIELDS

[75] Inventors: Albertus A. S. Sluyterman; Gerrit Bosch; Fransiscus M. P. P. Doomernik; Adriaan J. Groothoff, all of Eindhoven, Netherlands

[73] Assignee: U.S. Philips Corporation, New York, N.Y.

[21] Appl. No.: 154,811

[22] Filed: Feb. 11, 1988

Related U.S. Application Data

[63] Continuation-in-part of Ser. No. 145,651, Jan. 13, 1988, which is a continuation of Ser. No. 919,910, Oct. 16, 1986, abandoned.

[30] Foreign Application Priority Data

| | | | |
|---|---|---|---|
| Oct. 25, 1985 | [NL] | Netherlands | 8502918 |
| Sep. 23, 1986 | [NL] | Netherlands | 8602397 |
| Feb. 24, 1987 | [NL] | Netherlands | 8700449 |

[51] Int. Cl.[5] ..... H01J 29/70

[52] U.S. Cl. ..... 313/431; 313/437; 313/440; 335/213; 335/214

[58] Field of Search ..... 313/431, 440, 436, 437, 313/430; 335/210, 213, 214

[56] References Cited

U.S. PATENT DOCUMENTS

| | | | |
|---|---|---|---|
| 2,994,803 | 8/1961 | Goldberg | 313/437 X |
| 4,484,166 | 11/1984 | Osinga et al. | 313/431 |
| 4,635,934 | 1/1987 | Toshiyasu et al. | 335/214 |
| 4,709,220 | 11/1987 | Sakane et al. | 335/214 |
| 4,758,810 | 7/1988 | Tamura | 335/213 |

*Primary Examiner*—Donald J. Yusko
*Assistant Examiner*—Michael Horabik
*Attorney, Agent, or Firm*—Michael E. Marion

[57] ABSTRACT

Picture display device having a display tube (3) and a deflection unit (9) comprising a field deflection coil and a line deflection coil (11). To comply with a predetermined interference radiation standard, the picture display device comprises a first set of (horizontal) interference suppression coils 18, 19 arranged symmetrically relative to the plane of symmetry of the line deflection coil and a second set of (vertical) interference suppression coils 18*a*, 19*a* arranged at right angles to the plane of symmetry of the line deflection coil, which coils are oriented in such manner and in operation are energizable in such manner that, measured at a predetermined distance from the picture display device, at least the strength of the local magnetic dipole field is below a desired standard. Each coil of the second set preferably comprises at least two sub-coils arranged parallel to each other at a given distance in order to reduce the energy content of the coil system.

5 Claims, 2 Drawing Sheets

PICTURE DISPLAY DEVICE HAVING MEANS FOR COMPENSATING LINE STRAY FIELDS

This application is a continuation in part and specifically incorporates by reference, U.S. Ser. No. 145,661, filed Jan. 13, 1988 which is itself a continuation of Ser. No. 919,910 filed on Oct. 16, 1986, now abandoned.

BACKGROUND OF THE INVENTION

The invention relates to a picture display device having a display tube whose rear part consists of a cylindrical neck accommodating a device for generating electron beams and whose front part is funnel-shaped with the widest part being present on the front side, and a picture display phosphor screen. The display device also being provided with an electromagnetic deflection unit mounted around the display tube for deflecting electron beams across the display screen and comprising a line deflection coil and a field deflection coil which, when energized, generate magnetic fields having at least a dipole component.

Recently more stringent standards have been introduced for certain types of picture display devices, notably for monitors, with respect to the magnetic interference field which they may produce around them. So far protective shields have sometimes been used in picture display devices such as, for example a metal cone envelope for the combination of display tube and deflection unit, but such protective shields are intended to inhibit the influence of external fields on the display device rather than reducing magnetic interference fields generated by the picture display device. An important source of magnetic interference fields is the line deflection coil because it is operated at radiofrequency currents (frequencies in the range of 10 to 100 kHz) as contrasted to the field deflection coil. It is impossible to design a satisfactorily operating deflection coil that produces no stray field. If the stray field were to be eliminated by means of a protective shield, such a shield would only be effective if the combination of display tube and deflection unit were also shielded on the display screen side.

SUMMARY OF THE INVENTION

It is an object of the invention to comply with the required radiation standards without using shielding means. According to the invention, in a picture display device of the type described in the opening paragraph this object is realized in that the device is provided with a compensation coil system which is oriented in such manner and in operation is energizable in such manner that, measured at a predetermined distance from the picture display device, at least the strength of the local magnetic dipole field is below a desired standard. The compensation coil system includes a first set of compensation coils arranged symmetrically relative to the plane of symmetry of the line deflection coil on the outer side of the deflection unit, and extending with main portions of their lengths in the axial direction, and two further compensation coils arranged symmetrically relative to the plane of symmetry of the line deflection coil on the outer side of the deflection unit and extending at least substantially parallel to the display screen.

The invention is based on the recognition that for interference suppression of magnetic fields at a long distance from the interfering source (distances of, for example more than 3 m) it is sufficient to compensate the dipole component only. Deflection units also produce higher order (for example sixpole and tenpole) magnetic deflection field components, but their strength decreases much more rapidly as the distance increases than the strength of the dipole component so that their contributions are already negligible at a distance of approximately 50 cm. The magnetic dipole moment of an interfering source (the line deflection coil) can be compensated by adding an opposed dipole moment. This dipole moment can be obtained by energizing two current loops positioned on the outer side of the line deflection coil and extending with two main portions of their lengths at least approximately parallel to the tube axis on facing sides thereof, said current loops having the required number of turns, the required surface area and the required orientation. Energizing may be effected by arranging the compensation coils constituted by the current loops in series with or parallel to the line deflection coil.

The compensation coils should preferably cover a surface area which is as large as possible. The larger the surface area the less energy will be required to generate a desired magnetic dipole moment. A surface area of, for example 1 to 10 $dm^2$ has been found suitable in practice.

The number of turns of the compensation coils may be small (less than 10). In many cases 2 to 6 turns may suffice. To reduce the interference field at distances of approximately 50 cm the compensation coil system according to the invention comprises two further compensation coils which are arranged on the outer side of the deflection unit symmetrically relative to the plane of symmetry of the line deflection coil and extending parallel to the display screen. During operation they should be energized in the same manner as the first compensation coils.

As stated hereinbefore, the compensation coils should be large in order to reduce the energy content.

However, a problem is that many types of display devices (particularly monitors) lack the space to accommodate large coil systems in the correct position. Consequently, relatively small (too small) compensation coils must be used so that the radiation compensation consumes much (line deflection) energy. The space available for the coils to be arranged parallel to the display screen is mostly too small.

In a preferred embodiment of the picture display device according to the invention this problem is reduced in that the two further compensation coils each comprise at least two sub-coils arranged in parallel at a predetermined distance. Their effect will be explained hereinafter.

The first compensation coils may be formed by current loops whose turns are substantially co-planar parallel to the plane of symmetry of the line deflection coil. It is, however, practical to form them as saddle coils which are mounted on the outer side of the electromagnetic deflection unit. Particularly if these saddle coils are of the so-called yoke winding type (i.e. wound on a support) they may be formed in such a manner that two main portions of their length extend in the axial direction on facing sides of the tube axis, which main portions together with connection portions connecting them at the ends define at least two coil windows of different size. By adjusting the surface areas of the windows (and hence of the total "effective" coil surface) it is possible to adapt the compensating dipole field to the stray field of each line deflection coil with which the first compensation coils are combined.

DETAILED DESCRIPTION OF THE PREFERRED EMBODIMENT

Figure 1A:
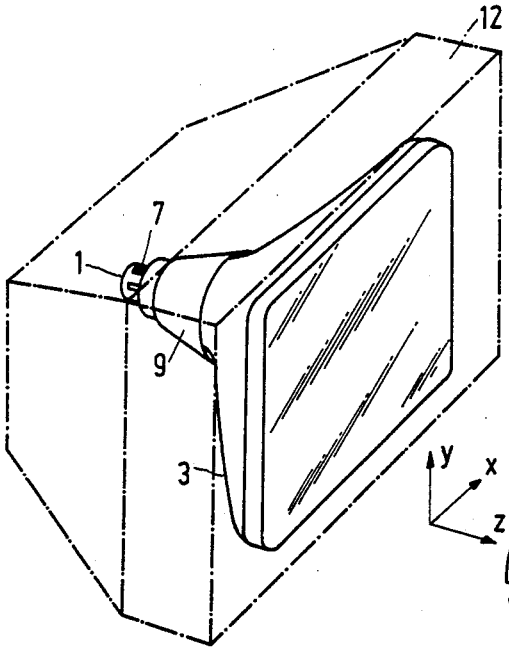
FIG. 1*a* is a perspective elevational view of a picture display device with a display tube, FIG. 1*b* diagrammatically shows an electromagnetic deflection unit with a line deflection coil.

FIG. 1*a* is a perspective elevational view of a combination of a deflection unit and a display tube placed in a cabinet 12 which can be provided with means to compensate interference fields, according to the invention. For the sake of clarity all details which are unimportant for understanding the invention have been omitted.

The display tube has a cylindrical neck 1 and a funnel-shaped portion 3 the widest part of which is present on the front side of the tube and comprises a display screen (not shown).

Figure 1B:
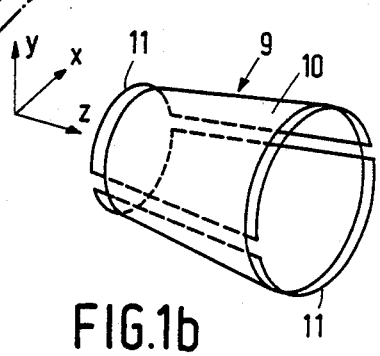

The display screen comprises phosphors which upon impingement by electrons luminesce in a predetermined colour. The rear part of the neck 1 accommodates an electron gun system 7 (shown diagrammatically). At the area of transition between the neck 1 and the funnel-shaped portion 3 an electromagnetic deflection unit 9 diagrammatically shown is arranged on the tube, which unit includes a line deflection coil 11 (FIG. 1*b*) for deflecting the electron beams in a horizontal direction x. As is shown in FIG. 1*b* the line deflection coil 11 may consist of, two saddle-shaped coil halves. In the operating condition a sawtooth current having a frequency of between 10 and 100 kHz a frequency of approximately 6 kHz flows through these coils. Generally the line deflection coil 11 is surrounded by an annular core element 10 of soft magnetic material, the so-called yoke ring, which is shown in FIG. 1*b*.

When the radiation field of a line deflection coil having a yoke ring is initially equally large but opposed to that of a coil without a yoke ring, the line deflection coil can be assumed for large distances to be a current loop having a given magnetic moment.

The field $B_o$ in the center of a line deflection coil without a yoke ring can be calculated to be approximately 30 Gauss. The field of a practical deflection coil with a yoke ring has approximately twice this value.

The line deflection coil field at 1 m distance is approximately 1 mGauss.

This radiation field can be compensated by means of an auxiliary loop current having a low nI value and a large radius such that the magnetic moment is the same as that of the coil itself. Such an auxiliary loop current can be generated by means of a compensation loop having a radius $R_c=20$ cm and with a number of turns $n_c=4$. In this manner a reduction of 40 dB can be realized, for example at a distance of 3 m and more from the radiation source. The orientation of the compensation loop should be such that the magnetic dipole moment generated upon current passage through this coil at a predetermined distance (for example 3 m) compensates the magnetic dipole moment of the interfering component. To this end the dipole moment of the compensation loop should be parallel to and oppositely directed relative to the dipole moment of the interfering component. The interfering component is the line deflection coil in the first place. However, the line output transformer may also generate an interference field and can then be considered as an interfering component. In that case it applies that:

Parallel dipole moments originating from one or more components can be compensated with one current loop. Non-parallel dipole moments can be compensated with one loop when the frequency and the phase of the dipole moments to be compensated are the same.

Thus it is possible to compensate the magnetic stray fields of a device comprising a number of directly interfering sources (line output stage, deflection coil) and a number of indirect sources ("reflectors", base plates) with the aid of a compensation loop having a limited number of turns and a given diameter.

By choosing the number of turns to be low and the surface area to be large the following conditions can always be satisfied:

1. The magnetic dipole moment vector is equal to the sum of the dipole moments of all direct sources in the device.
2. The load on the supply and the interference on the components in the device itself, notably the deflection coil, is sufficiently small.

Figure 2:
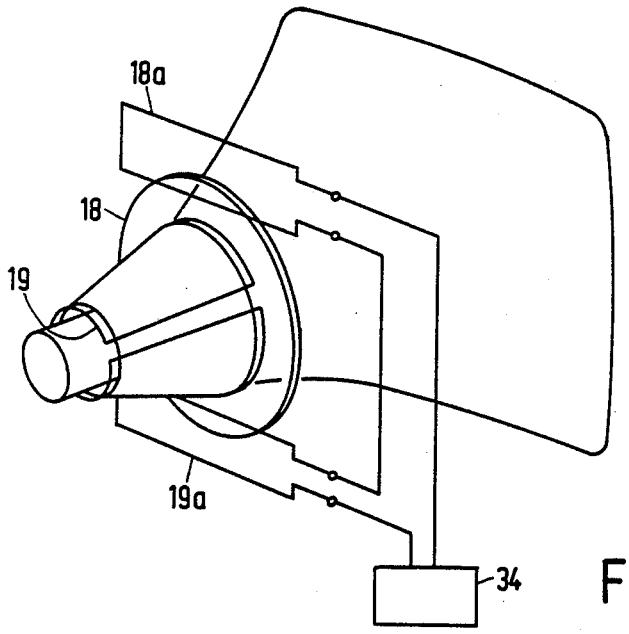
FIG. 2 is a perspective rear view of a display tube on which two sets of compensation coils have been mounted, FIG. 3 diagrammatically shows a coil-tube combination in a longitudinal section with two sets of compensation coils.

FIG. 2 shows a deflection unit having two sets of interference coils, a horizontally arranged set 18, 19 and a vertically arranged set 18*a*, 19*a*. By choosing the number of turns of the vertically arranged set to be different from that of the horizontally arranged set and by correctly choosing both the current directions and the sizes of the horizontally and vertically arranged sets, a considerable field reduction at distances of approximately 50 cm can be realized. As far as the correct choice of the current directions is concerned, this notably implies that upon energization of the interference suppression coil system the currents in the horizontally arranged parts flow in the same direction as the currents in the corresponding (axial) parts of the line deflection coils and that the currents in the vertically arranged parts flow in a direction which is opposite to the direction of the corresponding (transversal) parts of the line deflection coils.

Figure 3:
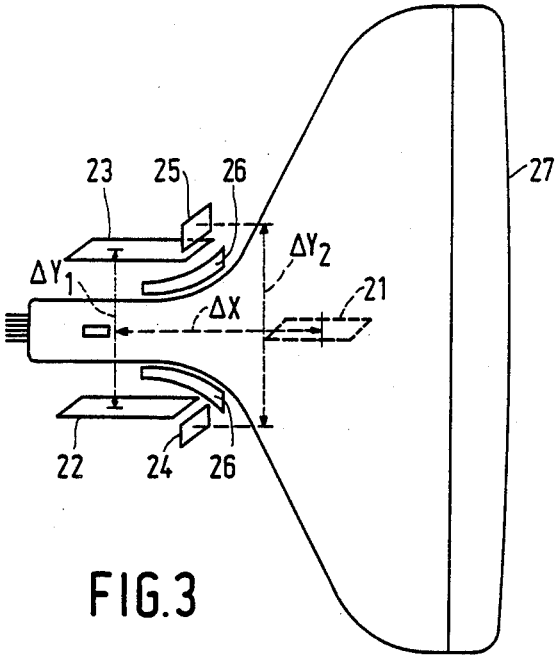

The operation of the coil arrangement of FIG. 2 will now be explained with reference to FIG. 3. The interfering field of the line deflection coil 26 can be roughly assumed to be a dipole in the tube 27 (=coil 21). Compensation is effected by means of a first set of compensation coils 22 and 23 which are symmetrically arranged relative to the plane of symmetry of the line deflection coil of the deflection unit 26. However, due to the distance $\Delta Y_1$ between the coils 22 and 23 a 6-pole component is produced and due to the distance $\Delta X$ a 4-pole component is produced. If the coils 22, 23 are moved forwards (to reduce $\Delta X$ and hence the 4-pole), $\Delta Y_1$ increases and hence the 6-pole increases. For this reason $\Delta Y_1$ remain small; the 6-pole can be reduced to a slight extent by enlarging the diameter of the first compensation coils 22 and 23 which results in $\Delta X$ necessarily increasing because the coils cannot be inserted in the tube. A 4-pole proportional to the size of the coil, the current through a second set of compensation coils in the form of coils and the distance $\Delta Y_2$ is predominantly generated with two vertical coils 24 and 25. The 4- and the 6-poles can be neutralized by correct combination of coil sizes and current intensities. For the 8-poles all coils should not become so large that they are tangential to the measuring circle because then the 8-poles and even higher harmonics start playing a role.

Figure 4:
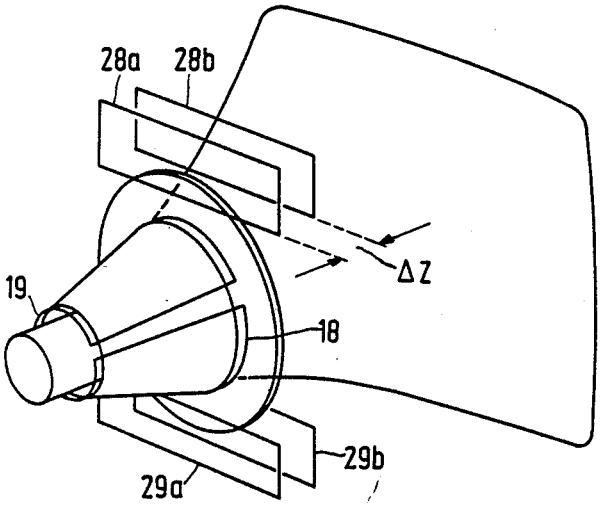
FIG. 4 is a perspective rear view of a display tube with a set of single and a set of double compensation coils.

As already noted hereinbefore, it is important to have big-sized interference suppression coils in connection with their energy consumption. If this is not possible the invention provides the solution of building up the coils of the system arranged at right angles to the plane of symmetry of the line deflection coil from at least two sub-coils (28*a* and 28*b* and 29*a* and 29*b*, respectively in FIG. 4). By arranging the sub-coils of each pair at a predetermined distance ($\Delta Z$) from each other, it can be ensured that there is a minimum mutual inductance. In the case of two sub-coils, each sub-coil pair may have half the number of turns which would otherwise be required for a single coil. This means that the inductance of the system with two pairs of sub-coils may be half the inductance of a set of single coils. This results in a reduction of the energy content.

Figure 5:
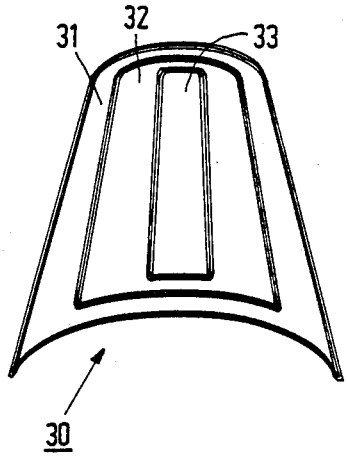
FIG. 5 is a diagrammatic plan view of a compensation-coil half with three windows.

The saddle coils 18, 19 may be of the so-called yoke winding type. This means that they are directly wound on a support. This support may include two grooved flanges which are secured to the front and rear sides of the deflection unit. The positions of the axially extending turn portions can be fixed by means of the grooves. For use in different deflection units, universal flanges (with grooves uniformly distributed over the circumference) can be used to wind compensation coils having two or more coil windows of different size. In this manner the "effective" compensation coil surface area can be adapted to each line deflection coil with which the compensation coil is combined. FIG. 5 is a diagrammatic plan view of a compensation saddle coil half 30 having three coil windows 31, 32 and 33 of different size.

What is claimed is:

1. A picture display device having a display tube the rear part of which consists of a cylindrical neck accommodating a device for gnerating electron beams and the front part of which is funnel-shaped with the widest part being present on the front side, and a picture display phosphor screen, said display device also being provided with an electromagnetic deflection unit mounted around the display tube for deflecting electron beams across the display screen and comprising a line deflection coil and a field deflection coil which, when energized, generate magnetic fields having at least a dipole component, characterized in that the device is further provided with a compensation coil system which is oriented in such manner and in operation is energizable in such manner that, measured at a predetermined distance from the picture display device, at least the strength of the local magnetic dipole field is below a desired standard, said compensation coil system comprising a first set of compensation coils arranged symmetrically relative to the plane of symmetry of the line deflection coil on the outer side of the deflection unit, and extending with main portions of their lengths in the axial direction, and a second set of compensation coils arranged symmetrically relative to the plane of symmetry of the line deflection coil on the outer side of the deflection unit and extending at least substantially parallel to the display screen.

2. A display device as claimed in claim 1, characterized in that the second set of compensation coils comprises two pairs of parallel sub-coils arranged in parallel with each sub-coil at a predetermined distance from the other sub-coil of the pair.

3. A display device as claimed in claim 1, characterized in that the first compensation coils each comprise a saddle-type coil mounted on the electromagnetic deflection unit.

4. A display device as claimed in claim 3 wherein each saddle-type coil defines at least two coil windows of different size, each coil window being bounded by two main portions parallel to the tube axis and two connecting portions connecting the ends of said main portions.

5. A display device as claimed in claim 4, characterized in that the saddle coils are of the yoke winding type.

* * * * *